United States Patent [19]

Givens et al.

[11] Patent Number: 4,461,694

[45] Date of Patent: Jul. 24, 1984

[54] COAL LIQUEFACTION PROCESS WITH ENHANCED PROCESS SOLVENT

[75] Inventors: Edwin N. Givens, Bethlehem; Dohee Kang, Macungie, both of Pa.

[73] Assignee: International Coal Refining Company, Allentown, Pa.

[21] Appl. No.: 445,798

[22] Filed: Dec. 1, 1982

[51] Int. Cl.[3] ..... C10G 1/00

[52] U.S. Cl. ..... 208/8 LE

[58] Field of Search ..... 208/8 LE

[56] References Cited

U.S. PATENT DOCUMENTS

| | | | |
|---|---|---|---|
| 3,841,991 | 10/1974 | Cohen et al. | 208/8 LE |
| 3,867,275 | 2/1975 | Gleim et al. | 208/8 LE |
| 4,070,268 | 1/1978 | Davis et al. | 208/8 LE |
| 4,085,031 | 4/1978 | Walchuk | 208/8 LE |
| 4,094,766 | 6/1978 | Gorin | 208/8 LE X |
| 4,119,523 | 10/1978 | Baldwin et al. | 208/8 LE |
| 4,164,466 | 8/1979 | Baldwin et al. | 208/8 LE X |
| 4,189,371 | 2/1980 | Maa et al. | 208/8 LE |
| 4,189,372 | 2/1980 | Baldwin et al. | 208/8 LE |
| 4,297,200 | 10/1981 | Briley | 208/8 LE X |
| 4,372,838 | 2/1983 | Kulik et al. | 208/8 LE X |
| 4,374,015 | 2/1983 | Brulé | 208/10 X |

*Primary Examiner*—Delbert E. Gantz
*Assistant Examiner*—William G. Wright
*Attorney, Agent, or Firm*—Kimbley L. Muller

[57] ABSTRACT

In an improved coal liquefaction process, including a critical solvent deashing stage, high value product recovery is improved and enhanced process-derived solvent is provided by recycling second separator underflow in the critical solvent deashing stage to the coal slurry mix, for inclusion in the process solvent pool.

4 Claims, 2 Drawing Figures

COAL LIQUEFACTION PROCESS WITH ENHANCED PROCESS SOLVENT

The Government of the United States of America has rights in this invention pursuant to Contract No. DE-AC05-780R03054 (as modified) awarded by the U.S. Department of Energy.

BACKGROUND OF THE INVENTION

This invention pertains to an improved coal liquefaction process with enhanced product recovery and process solvent obtained by recycle of a heavy solvent refined coal fraction from the critical solvent deashing stage.

A wide variety of processes have been proposed for the conversion of coal to a low-sulfur, low-ash solid carbonaceous fuel and distillate hydrocarbon fuel by solvent refining of the coal in the presence of a hydrogen donor solvent. Typically, upon heating and liquefaction of the coal in such a process, light gases are first separated and the remaining slurry vacuum distilled to produce a light distillate product, a recycle solvent, and a heavy fraction including, among other things, residual solvent, dissolved coal products, undissolved and heavy coal products, mineral or ash material and unconverted coal macerals.

It is well-known that further products may be recovered by solvent deashing this vacuum still bottom stream or residium. Such a process, sometimes referred to as a "critical solvent deashing" process, is disclosed, for example, in U.S. Pat. No. 4,070,268. As indicated in that patent, typical products of the solvent deashing stage include a stream comprised of soluble coal products, the composition of which is rich in preasphaltenes but which is essentially free of ash and unconverted coal particulate matter. This low-sulfur carbonaceous material is ideally suited for combustion in an environmentally acceptable manner. A bottom stream of insoluble coal products and ash is also normally produced as well as an overhead stream of distillate which is recycled as solvent in the deashing stage.

As seen in U.S. Pat. No. 4,164,466, the solvent deashing stage often comprises a number of product separation zones, typically of successively higher pressure, all maintained at relative high temperature. U.S. Pat. No. 4,164,466 also discloses a process wherein the underflow from the second separation zone is recycled to the entry mixing zone in the solvent deashing stage.

In the process disclosed in U.S. Pat. No. 4,189,372, a portion of the underflow from the third and fourth separators is hydrogenated and returned to the coal liquefaction slurry tank. Substantially all other intermediate flows from the second, third, and fourth separators are recycled to the mixing zone at the entry of the solvent deashing stage.

In U.S. Pat. No. 4,119,523, the underflow from the first separator in a solvent deashing stage is extracted, to separate resulting ash and undissolved coal, and the remaining extract returned to the coal liquefaction stage.

Notwithstanding this prior art, there remains a need for still further enhanced product recovery in a coal liquefaction process including solvent deashing.

It is therefore the general object of the present invention to provide such an improved process.

BRIEF DESCRIPTION OF THE INVENTION

The present invention involves a solvent coal refining process in which, following liquefaction and light gas separation, the coal slurry is subjected to a vacuum distillation, the bottom stream of which is solvent deashed. In solvent deashing, the solvent-vacuum bottom slurry is subjected to a sequence of separation steps at elevated temperature and pressure. THe present invention involves an improvement in that process, wherein underflow from the second stage separation in the solvent deashing process, which is referred to and defined hereinafter as "Heavy SRC" or "HSRC", is recycled and utilized as additional solvent in the initial coal slurry mix zone of the process. In this manner, a higher proportion of solvent is provided for recycle within the process, so as to decrease the amount of distillate solvent required, while the proportion of light off-gases is decreased and the amount of hydrogen required for the liquefaction zone is also decreased.

In the preferred form of the present invention, the deashing process involves a solvent to vacuum still bottom ratio in the deashing stage entry mixer of from 1-10 and a first stage separation zone operated at 750-1000 psig and 450°-600° F. In this first separation zone, deashing solvent is flashed off and recycled to the deashing stage mixer, while a first light phase is withdrawn and passed to a second separation zone, operated at 600°-850° F., most preferably 630°-700° F., while the pressure is maintained at 750-1000 psig. A heavy phase, comprising solid, insoluble ash, undissolved coal, and dissolved coal, is removed.

In the second separation zone, a second light phase is withdrawn as overflow and passed to a third separation zone for separation of deashing solvent from the remaining SRC, which is referred to and defined hereinafter as "Light SRC" or "LSRC". A second heavy phase is withdrawn as underflow and is primarily comprised of Heavy SRC.

In accordance with this invention, the Heavy SRC material, comprising primarily molten deashed soluble coal products, is recycled, in whole or in part, to the coal mixing slurry surge tank at the beginning of the coal liquefaction process.

DETAILED DESCRIPTION OF THE INVENTION

For purposes of this invention, two distinct Solvent Refined Coal (SRC) materials are obtained from the critical solvent deashing (CSD) stage of the process. These materials are referred to and herein defined as Heavy SRC and Light SRC and have the properties set forth in Table 1.

The term "Light SRC" or "LSRC" refers to and defines that SRC material which is obtained as underflow from the third stage separator(s) in the critical solvent deashing (CSD) process or an equivalent material. It is comprised of approximately one third (⅓) oils, which are pentane soluble, and two thirds ($\frac{2}{3}$) asphaltenes, which are pentane insoluble-benzene soluble. LSRC has a softening point of about 180° F. (82.2° C.).

The term "Heavy SRC" or "HSRC" refers to and defines that SRC material which is obtained as deashed underflow from the CSD process second stage separator, or an equivalent material. It is comprised of about equal amounts of asphaltenes, which are pentane insoluble-benzene soluble, and preasphaltenes, which are benzene insoluble-pyridine soluble, with only a trace amount (about 1%) soluble in pentane. HSRC has a softening point of about 380° F. (193.3° C.).

A primary advantage provided by the process of the present invention is that an increased amount of economically more valuable and desirable Light SRC, which was otherwise required for recycle to the process solvent pool, is now available to be taken as product. Correspondingly, there is commensurate decrease in the amount of less valuable Heavy SRC, which is removed from the process stream as product. This is made possible because the portion of HSRC recycled not only serves to substitute in the process solvent pool for a like amount of LSRC, but further because the HSRC is converted into lower molecular weight, distillate material, (e.g., distillate oils), as a result of recycle through the liquefaction zone.

TABLE 1

| SRC Properties | LSRC | HSRC |
|---|---|---|
| Wt %, Carbon | 85.4 | 85.9 |
| Hydrogen | 6.8 | 5.8 |
| Oxygen | 4.3 | 4.2 |
| Nitrogen | 1.6 | 2.1 |
| Sulfur | 1.0 | 1.1 |
| Ash | 0.1 | 0.1 |
| Wt %, Pentane Soluble Oil | 29.4 | 1.0 |
| Asphaltene | 65.2 | 43.5 |
| Preasphaltene | 5.0 | 55.5 |
| Molecular Weight determined by vapor pressure osmometry | 335 | 640 |
| Softening Point, °F. | 180 | 380 |
| Wt % Oxygen present as hydroxyls in asphaltene | 2.0 | 1.5 |
| Wt % Nitrogen present as amides and amines in asphaltene | 0.6 | 0.3 |

Figure 2:
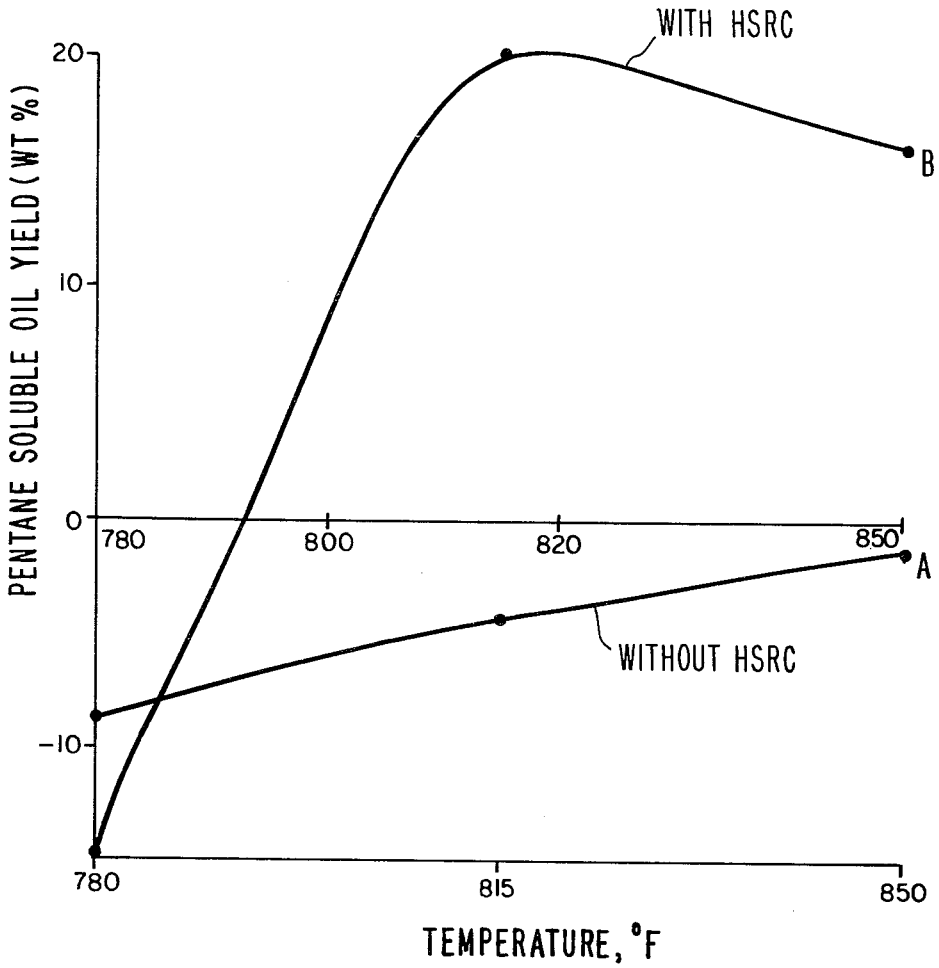
FIG. 2 is a graph comparing the relationship between temperature and the yield of pentane soluble oil product, both in accordance with the prior art and the present invention.

FIG. 2 demonstrates the increased yield of pentane soluble material (e.g., distillate oils) produced at three temperatures with HSRC added to the process solvent pool in accordance with the invention. A better yield of pentane soluble oil product is obtained at temperatures greater than 800° F. (426.7° C.).

For a better understanding of the present invention, reference may be made to the detailed description which follows, taken in conjunction with the accompanying Figure and the appended claims.

Figure 1:
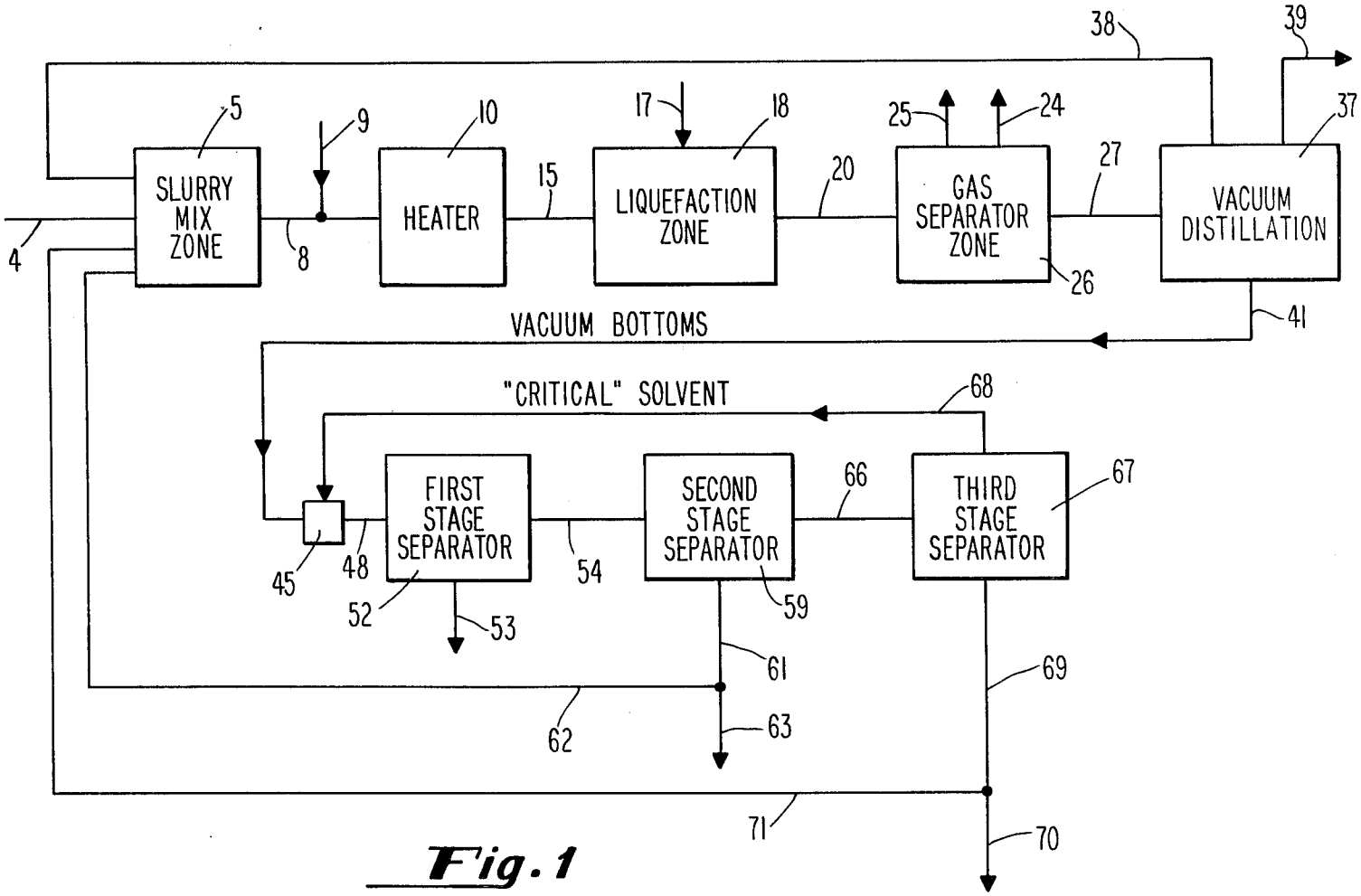
FIG. 1 is a schematic flow diagram of a coal liquefaction process with a solvent deashing stage, in which is incorporated the process improvement of the present invention.

As shown in FIG. 1, the improved coal liquefaction process of this invention comprises a coal liquefaction slurry mix zone 5, to which is introduced a feed stream 4 of finely divided coal and make-up solvent (to the extent make-up solvent may be required) and recycle streams 38, 62, and 71. Slurry from mix zone 5 is pressurized and passed through line 8 to heater 10 and thence through transfer line 15 to liquefaction zone 18. Typically, liquefaction zone 18 comprises high pressure tubular reactors. Liquefaction of coal in the heater slurry is enhanced by hydrogenation; for that purpose, hydrogen is introduced to the slurry through feed lines 9 and 17 in transfer line 8 and liquefaction zone 18, respectively.

After suitable residence time which generally ranges between 10–120 minutes in liquefaction zone 18, the coal slurry-solvent mixture is passed through transfer line 20 to gas separator zone 26, in which light end streams 24 and 25 are flashed off, following which the slurry is transferred through transfer line 27 to a vacuum distillation stage 37, from which a distillate product 39, and a recycle solvent stream 38 are removed, along with a vacuum distillation bottom stream 41. The latter is transferred to a critical solvent deashing stage for further product and solvent recovery. The entry point of the solvent deashing stage is a deashing solvent mix zone 45. Recycle deashing solvent flashed in downstream separators in the solvent deashing stage may be introduced into mix zone 45 (for example, as indicated by recycle transfer line 68), following which the mix is transferred through line 48 to a first stage separator 52 and thence successively to second and third stage separators 59 and 67.

Underflow streams 53, 61, and 69 are removed respectively from the three stage separators of the solvent deashing stage. Underflow 53 of the first stage separator generally comprises ash and heavy insoluble coal products; other constituents may be extracted from underflow 53, such as deashing solvent which may be recycled. In the present process, underflow 53 is generally, though not necessarily, used for hydrogen generation.

Underflow stream 61 comprising primarily Heavy SRC has heretofore been removed via line 63 and used primarily as fuel, or for catalytic hydroprocessing. In accordance with the present invention, underflow stream 61 is recycled via line 62, in whole or in part, to the coal liquefaction entry mixer zone 5.

Underflow stream 69 comprised primarily Light SRC and may be either recycled via line 71 to coal liquefaction entry mixer zone 5, or removed via line 70 as fuel or for catalytic hydroprocessing. In preferred embodiments of this invention, substantially all of the LSRC is removed as product or for further product enhancement processing (e.g., hydrotreating) via line 70. In such preferred modes, substantially none of the LSRC is recycled via line 71, since the process solvent pool requirements are satisfied by recycle of HSRC via line 62, as previously indicated.

Referring generally to the coal liquefaction process, of which the present invention is a part, this process comprises a non-catalytic method for producing low-sulfur, low-ash solid carbonaceous fuel, and a distillate hydrocarbon fuel. Specifically, coal is liquified by subjecting it to a hydrogen donor solvent in the presence of hydrogen, or more commonly a hydrogen-rich gas. After dissolution, the products are separated into gaseous materials, distillate fractions, and vacuum distillation bottoms. The residium containing entrained mineral matter (ash) and unconverted coal macerals is then subjected to a solvent deashing stage, sometimes referred to as "critical solvent deashing" essentially as disclosed in U.S. Pat. No. 4,070,268. The product of this solvent deashing stage is a stream comprised of soluble coal products, the composition of which is rich in preasphaltenes but essentially free of ash and unconverted coal particulate matter. This low-sulfur, carbonaceous material is ideally suited for combustion in environmentally acceptable operations. In the operation of such a coal liquefaction complex, the dissolving section must be capable of generating sufficient process solvent or have available sufficient outside supplies to meet the solvent, sometimes referred to as "pasting oil" demand of the plant.

The present invention contributes significantly to meeting that solvent demand by adding to the available recycle stream solvent make-up. This is done by recycling the underflow of the second deashing stage separator (i.e., Heavy SRC) in the solvent deashing stage to the coal slurry mixer. Under certain conditions as disclosed herein, the solvent balance of the plant can be met, in accordance with the present invention, without an outside supply of solvent.

In such processes, the feed coal is of a rank lower than anthracite, such as bituminous, or sub-bituminous, or lignite, or mixtures thereof. The feed coal may be directly from the mine or may be reclaimed, and it may be ground to a size typically less than 8 mesh, but preferably less than 20 mesh, and dried to removed substantial moisture to a level, for bitumious or sub-bitumious coals, of less than 4%.

For solvent liquefaction, the coal is slurried with a solvent or "pasting oil" that may be comprised of a coal-derived oil, obtained in the coking of coals in a slot oven, commonly referred to as creosote oil, anthracene oil or other similar oils, or process-derived solvent. As previously indicated, such solvent as is provided from outside sources, may be replaced in whole or in part by recycle within the process, and particularly, in accordance with this present invention, recycle from the second (and/or third) stage separator of the deashing stage. In such a recycle stream, Heavy SRC may make up to 35% of the total pasting oil.

The coal is mixed with the process solvent at temperatures from ambient to 450° F. at concentrations of coal in the slurry of from 20–55% by weight. In the slurry mix tank, which must be maintained at elevated temperatures to keep the viscosity of the coal-solvent slurry low enough to pump, moisture entrained in the feed coal will be removed. If desired, maintaining the temperature in the tank at a still higher level will allow more moisture to escape as steam. The slurry from the tank is passed to a pumping unit that forces the slurry into a system maintained at higher pressures usually from 500–3200 psig.

This slurry is mixed with a hydrogen-rich gaseous stream at a ratio of from 1000–40,000 SCF per ton of feed coal. The three phase gas/slurry stream is then introduced into a preheater system comprised of a tubular reactor having a length to diameter ratio greater than 200 and more preferably greater than 500. The temperature of the three phase mixture is increased from the approximate temperature in the slurry tank to an exit temperature of 600°–850° F. This preheated exit slurry from the preheater, containing a small amount of undissolved coal, then enters the dissolver vessel (i.e., the "liquefaction zone").

In the preheater section, the viscosity of the slurry changes as the slurry flows through the tube forming initially a gel-like material which shortly thereafter diminishes sharply in viscosity to a relatively freely-flowing fluid. This fluid then enters the dissolver where other changes occur.

The ratio of total hydrogen gas to slurry in the liquefaction zone is maintained at a level to ensure an adequate hydrogen concentration in the exit slurry to prevent coking. Specific selection of flow through the dissolver is chosen such that the coal slurry with its incipient mineral particles move through the reactor with minimal entrainment of larger particles that are unable to exit the reactor. The quantity of solids that accumulate in the dissolver at these velocities is usually quite small based on feed.

The liquified slurry may be passed to an optional downstream dissolver or sent directly to a separator. In the separator, the dissolver effluent is led into a flash separating zone where the effluent is flashed and the overhead is cooled to a range of 100°–150° F. in heat exchangers which may be in multiple stages, all of which are well-known to the art. Higher separator temperatures may be desirable up to within 20°–50° F. of reactor outlet temperature. In such cases, appropriate equipment modifications would be made. Light gases, e.g., $H_2$, $H_2S$, $CO_2$, $NH_3$, $H_2O$, and $C_1$–$C_4$ hydrocarbons are removed in the flashing operation. These gases may be scrubbed to remove acidic or alkaline components, and the hydrogen and/or lower hydrocarbons may be recycled to various stages in the process or burned for fuel.

The remaining effluent consisting of liquid/solid slurry is passed to a vacuum distillation system where at least three streams are obtained: (a) light distillates (up to about 400° F. boiling point); (b) recycle solvent (boiling range of about 350°–1050° F.); and (c) solvent refined coal "SRC" (initial boiling point about 850° F.) plus recycle solvent. The recycle solvent stream is recycled to the coal feed-slurry mix tank to where it is combined in the initial coal/recycle solvent slurry.

The SRC stream (c) is the underflow from the vacuum distillation stage. As used in the present invention, the vacuum distillation still or tower typically operates at a pressure from 1–5 psia and a bottom temperature of about 500°–700° F. Light liquids are recovered either from this tower or a downstream distillation system. The process dissolving solvent is also obtained and recycled to the coal slurry surge tank. The hot vacuum still bottoms which contain the dissolved carbonaceous product, minerals, unconverted coal macerals, plus a small amount of remaining process solvent are solvent deashed and further refined by a process known as the Kerr-McGee critical solvent deashing process, which is fully defined in the U.S. Pat. No. 4,119,523.

In the critical solvent deashing zone, the hot vacuum still bottoms are transferred to a mix tank in which it is combined with critical deashing solvent. The weight ratio of deashing solvent to vacuum still bottoms is from 1–10. After complete mixing, the slurry is introduced, at a pressure from 750–1000 psig and a temperature from 450°–630° F., into the first separator.

Two phases separate in the first separator: (1) a first light phase comprising deashing solvent and dissolved coal and (2) a first heavier lower phase comprising (a) solid, insoluble mineral ash; (b) undissolved coal; (c) dissolved coal; and (d) a small amount of deashed solvent. The heavy phase is withdrawn from the lower portion of the separator. Deashing solvent may be flashed off and passed to the deashing solvent mixer, if desired. The remaining solids, insoluble ash, undissolved coal, and dissolved coal, referred to as ash concentrate, are removed from the system and may be passed to equipment for hydrogen generation.

The light phase formed in this first separator is withdrawn and passed into a second separator. The temperature of this light phase is increased to about 600°–850° F., preferably to about 630°–700° F., while the pressure is maintained at about 750–1000 psig. Separation occurs with a second light phase rising to the top and a second heavy phase settling to the bottom. The second heavy phase is withdrawn with a reduction in pressure. Deashing solvent is flashed off and recycled for reintroduction into the deashing solvent mix zone. The remaining solvent-free material is molten deashed Heavy SRC. In accordance with the present invention, at least a portion of this material is passed to the coal mixing slurry surge tank where it is incorporated into the feed slurry.

The second separator is operated in such a manner to increase the density of the overhead fraction by including a portion of the soluble coal product, i.e., Light SRC. As disclosed in U.S. Pat. No. 4,070,268, Light SRC can be recombined with the process solvent insolated from the vacuum distillation tower.

For certain situations where the Light SRC has increased value such as a feed for downstream hydrotreating equipment where a large volume of distillate fuels will be generated, a decrease in residual benzene-insoluble SRC, i.e., Heavy SRC, is desirable. The Heavy SRC will serve as a substitute for a portion of the process solvent required to slurry feed coal. This means that part of the distillate recycle solvent can be replaced by the Heavy SRC and a 35–50% concentration of feed coal in slurry can still be attained.

In accordance with the present invention, it has been found that the recycle of the Heavy SRC, as obtained from the second stage separator under proper conditions of temperature, pressure, and other process variables, will result in increased yield of distillate product. This additional distillate product can be continuously produced in a plant through recycle of Heavy SRC, or it can be practiced intermittently to balance any solvent shortage when such a situation arises.

A further advantage of this process is that a better yield of distillate of pentane-soluble oil product is obtained. An even better yield is obtained when the temperature is 20°–40° F. lower. This lower temperature not only results in higher distillate yield but also is accompanied by lower light hydrocarbon gas formation. A reduction in the amount of hydrocarbon gas formed leads to increased condensed carbonaceous product yields and lower hydrogen consumption (because the light end hydrocarbons are typically hydrogen-rich). Lower hydrogen consumption, in turn, lowers the cost of the overall process.

EXAMPLES

Example 1 (Comparative Example)

A slurry comprised of 30 wt. % of Kentucky #9 coal and 70 wt. % of creosote oil was prepared and passed through a 1 liter continuous stirred tank reactor at 2000 psig hydrogen pressure with 20,000 standard cubic feet of hydrogen per ton of coal at a slurry rate of 106 pounds of slurry per cubic foot of reactor per hour (equivalent to a 40 minute residence time). The yields and product distributions were determined at reaction temperatures of 780° F., 815° F., and 850° F. in the absence of added heavy solvent refined coal. Products of coal from this reaction are given in Table 2. The oil yields from the coal-creosote oil slurry feed were all negative at each temperature showing a net loss of oil products. However, with increasing process temperature, the net loss of oil products diminished but remained negative.

Example 2 (Intermediate Process)

Heavy solvent refined coal product used in subsequent experiments in this invention was produced in coal liquefaction run No. 167 at Wilsonville, Ala., as shown in Table 3. During the coal liquefaction run, the bottoms from the flash distillation tower were mixed with the critical deashing solvent and passed sequentially through two separators. Ash concentrate was recovered from the heavy phase of the first separator from which two streams were separated. The low density stream contained critical deashing solvent as well as light solvent refined coal. From the heavy phase of the second stage separator heavy solvent refined coal was isolated having the composition shown in Table 3.

TABLE 2

Product Yield Data Of Coal With Creosote Oil

| | | | |
|---|---|---|---|
| Coal | 30% KY #9 Coal | 30% KY #9 Coal | 30% KY #9 Oil |
| Solvent | 70% Creosote Oil | 70% Creosote Oil | 70% Creosote Oil |
| Temperature °F. | 780 | 815 | 850 |
| Conversion (wt. % MAF Coal) | 89.5 | 92.5 | |
| Yields (wt. % MAF Coal) | | | |
| Oils | −8.5 | −4.5 | −1.1 |
| Asphaltenes | 43.4 | 44.1 | 41.7 |
| Preasphaltenes | 48.7 | 44.5 | 37.0 |
| Unconverted Coal | 11.4 | 9.8 | 12.1 |
| SRC | 92.1 | 88.6 | 78.7 |
| Gases | | | |
| $C_1$–$C_4$ | 1.22 | 2.57 | 5.32 |
| $CO + CO_2$ | 0.51 | 0.62 | 0.86 |
| $H_2S + NH_3$ | 1.76 | 2.00 | 2.52 |
| $H_2O$ | 2.8 | 3.1 | 4.1 |
| Hydrogen Consumption (MAF) | 0.88 | 1.01 | 1.36 |

TABLE 3

Wilsonville Run Summary
Kentucky No. 9 Coal (Part 1 of 2)

| | |
|---|---|
| Run (MB)* | 167 |
| Mine | Laf |
| Solids W/D | Yes |
| R101 Psig | 2,100 |
| °F. | 825 |
| Space Rate, lb/hr-ft$^3$ | 53 |
| Feed Rate, lb/hr | 479 |
| Slurry Conc, % | 38.3 |
| Gas Feed Rate (scfh) | |
| to B102 | 10,000 |
| Bypass B102 | 0 |
| Hydrogen Consumption, MAF | 1.7 |
| Yield (wt % MAF) | |
| Gas | 6.9 |
| Light Oil | 2.3 |
| Wash Solv. | 2.0 |
| Process Solv. | 20.2 |
| SRC | 58.0 |
| UC | 7.4 |
| CSD Recovery | 75.0 |
| LSRC Recycle, lb/hr | 30.4 |

(Part 2 of 2)

| Composition of Heavy SRC | wt. % |
|---|---|
| Oils | 1.0 |
| Asphaltenes | 43.5 |
| Preasphaltenes | 55.5 |
| Carbon | 85.9 |
| Hydrogen | 5.8 |
| Oxygen | 4.2 |
| Nitrogen | 2.1 |
| Sulfur | 1.1 |
| Ash | 0.1 |

*Wilsonville - Quarterly Technical Progress Report, July-September, 1979, N.T.I.S. No. FE-2270-68, pg. 11, 23, 100–106 and 109–111

Example 3 (Demonstration of Invention)

This example illustrates the increased oil yields resulting from recycling of deashing stage second separator underflow to the coal-slurry. A pasting oil comprised of creosote oil and 15% Heavy SRC of Example 2 was slurried with 30% of Kentucky #9 coal and processed at the same reaction conditions described for Example 1. The data in Table 4, taken from three experimental runs, show that added Heavy SRC gives a negative oil yield of 780° F. The product contained less solvent than the feed slurry. As the process temperatures were increased to 815° F. and 850° F., the yield of oil product increased to 20.2% and 16.1%, respectively.

Clearly, the presence of Heavy SRC increases the net yield of oil. Likewise, these data clearly show that the optimum process temperature in the presence of Heavy SRC was about 815° F., which was at least 25° F. lower than in the absence of Heavy SRC in Example 1.

The decrease of optimum process temperature also resulted in the reduction of hydrogen consumption by 16%. Production of eight hydrocarbon gases from methane through butanes decreased at the optimum process conditions with Heavy SRC present.

TABLE 4

Yield Data Of Coal With Creosote Oil and Heavy SRC Mixture

| | | | |
|---|---|---|---|
| Coal | 30% KY #9 Coal | 30% KY #9 Coal | 30% KY #9 Oil |
| Solvent | 85% Creosote Oil Mixed With 15% HSRC | 85% Creosote Oil Mixed With 15% HSRC | 85% Creosote Oil Mixed With 15% HSRC |
| Temperature, °F. | 780 | 815 | 850 |
| Conversion (wt % MAF Coal) | 90.6 | 91.2 | 89.1 |
| Yields (wt % MAF Coal) | | | |
| Oils | −15.1 | 20.2 | 16.1 |
| Asphaltenes | 50.1 | 27.3 | 30.8 |
| Preasphaltenes | 49.8 | 34.0 | 26.7 |
| Unconverted Coal | 10.6 | 10.8 | 13.3 |
| SRC | 99.9 | 61.3 | 57.5 |
| Gases | | | |
| $C_1$-$C_4$ | 1.48 | 3.09 | 6.24 |
| $CO + CO_2$ | 0.47 | 0.74 | 0.91 |
| $H_2S + NH_3$ | 1.31 | 2.07 | 2.64 |
| $H_2O$ | 2.5 | 3.9 | 5.7 |
| Hydrogen Consumption | 0.61 | 1.17 | 1.76 |

Example 4 (Demonstration of Invention)

A mixture of 85% creosote oil and 15% Heavy SRC was processed at the same process conditions as used in Example 1. The product distribution, as tabulated in Table 5, shows that 11% of the Heavy SRC was converted to oils at 780° F., whereas at 815° F. and 850° F., the oil content of the product was less than feed, which demonstrates that retrograde conversions of oils to Heavy SRC (asphaltenes plus preasphaltenes) occurred at 815° F. and 850° F. reaction conditions. The degree of oil degradation was higher at 850° F. than 815° F., showing the optimum temperature for the stability of solvent in the presence of Heavy SRC.

Example 5 (Preliminary Process)

Creosote oil was hydrotreated over a cobalt molybdena on alumina catalyst in a fixed bed reactor. The elemental compositions of the starting creosote oil and the hydrotreated creosote oil were as follows:

| | Creosote Oil | Hydrotreated Creosote Oil |
|---|---|---|
| Carbon, wt. % | 90.0 | 90.0 |
| Hydrogen | 6.5 | 8.0 |
| Oxygen | 0.92 | 1.6 |
| Nitrogen | 1.4 | 0.5 |
| Sulfur | 0.8 | 0.2 |

The hydrotreated creosote oil was used as solvent in each of the subsequent examples.

Example 6 (Demonstration of Invention)

This example illustrates the liquefaction of Kentucky #9 coal when hydrotreated creosote oil was used as solvent instead of the creosote oil used in Example 1. A 30 wt. % slurry of Kentucky #9 coal mixed with 70% hydrotreated creosote oil was processed at the same three reaction conditions described for Example 1. The data in Table 6 are the yields and distribution of products from the conversion of coal with hydrotreated creosote oil.

Example 7 (Demonstration of Invention)

This example illustrates the increased oil yields and better product distribution resulting from recycling heavy solvent refined coal to the coal-slurry mixer. A pasting oil, compound of 85% hydrotreated creosote oil and 15% Heavy SRC produced according to Example 2, was slurried with 30% Kentucky #9 coal and processed at the same three reaction conditions described for Example 1. The data in Table 7 show that, at 780° F., adding Heavy SRC gave increased conversion and decreased oil yield, with an increase in process temperature, yield of oil product increased. Similar results were observed in Example 3. In the presence of Heavy SRC, the best overall yield distribution was again obtained at 815° F., which is 25° F. lower than in the absence of Heavy SRC in Example 5. The decrease of optimum process temperature also resulted in the reduction of hydrogen consumption by 14%. Production of light hydrocarbon gases from methane through butanes decreased at the optimum process conditions with Heavy SRC present.

TABLE 5

Hydrothermal Reactivity Data of Heavy SRC with Creosote Oil

| | | | |
|---|---|---|---|
| Heavy SRC | 15% HSRC | 15% HSRC | 15% HSRC |
| Solvent | 85% Creosote Oil | 85% Creosote Oil | 85% Creosote Oil |
| Temperature, °F. | 780 | 815 | 850 |
| Feed Compositions, wt. % | | | |
| Oils | 83.7 | 83.7 | 83.7 |
| Asphaltenes | 8.0 | 8.0 | 8.0 |
| Preasphaltenes | 8.3 | 8.3 | 8.3 |
| HSRC | 16.3 | 16.3 | 16.3 |
| Product Compositions, wt. % | | | |
| Oils | 85.4 | 80.4 | 74.5 |
| Asphaltenes | 7.9 | 11.0 | 16.9 |
| Preasphaltenes | 6.6 | 7.6 | 7.1 |
| HSRC | 14.5 | 18.6 | 24.0 |

TABLE 6

Product Yield Data of Coal with Hydrotreated Oil (Part 1 of 2)

| | | |
|---|---|---|
| Coal | 30% KY #9 Coal | 30% KY #9 Coal |
| Solvent | 70% Hydrotreated Creosote Oil | 70% Hydrotreated Creosote Oil |
| Temperature, °F. | 780 | 815 |
| Conversion (wt % MAF Coal) | 82.9 | 80.6 |
| Yields (wt % MAF Coal) | | |
| Oils | 12.3 | 8.2 |
| Asphatenes | 26.6 | 28.5 |
| Preasphaltenes | 40.1 | 36.3 |
| Unconverted Coal | 18.3 | 20.8 |
| SRC | 66.7 | 64.8 |
| Gases | | |
| $C_1$-$C_4$ | 1.20 | 3.06 |
| $CO + CO_2$ | 0.42 | 0.55 |
| $H_2S + NH_3$ | 2.05 | 2.61 |
| $H_2O$ | 0.18 | 1.36 |
| Hydrogen Consumption | 0.73 | 1.00 |

(Part 2 of 2)

| | |
|---|---|
| Coal | 30% KY #9 Coal |
| Solvent | 70% Hydrotreated Creosote Oil |
| Temperature, °F. | 850 |
| Conversion | 89.5 |
| Yields (wt. % MAF Coal) | |
| Oils | 4.1 |

TABLE 6-continued

Product Yield Data of Coal with Hydrotreated Oil

| | |
|---|---|
| Asphaltenes | 36.0 |
| Preasphaltenes | 39.8 |
| Unconverted Coal | 11.7 |
| SRC | 75.8 |
| Gases | |
| $C_1$-$C_4$ | 5.18 |
| $CO + CO_2$ | 0.89 |
| $H_2S + NH_3$ | 2.05 |
| $H_2O$ | 1.52 |
| Hydrogen Consumption | 1.87 |

TABLE 7

Product Yield Data Of Coal With Hydrotreated Creosote Oil and Heavy SRC Mixture

| | | | |
|---|---|---|---|
| Coal | 30% KY #9 Coal | 30% KY #9 Coal | 30% KY #9 Oil |
| Solvent | 85% Hydrotreated Oil Mixed With 15% Heavy SRC | 85% Hydrotreated Oil Mixed With 15% Heavy SRC | 85% Hydrotreated Oil Mixed With 15% Heavy SRC |
| Temperature, °F. | 780 | 815 | 850 |
| Conversion (wt % MAF Coal) | 88.8 | 87.5 | 87.9 |
| Yields (wt % MAF Coal) | | | |
| Oils | 3.4 | 11.8 | 10.6 |
| Asphaltenes | 13.0 | 21.0 | 11.5 |
| Preasphaltenes | 66.8 | 45.4 | 52.5 |
| Unconverted Coal | 12.1 | 13.4 | 13.3 |
| SRC | 79.8 | 66.3 | 64.0 |
| Gases | | | |
| $C_1$-$C_4$ | 1.51 | 3.39 | 7.02 |
| $CO + CO_2$ | 0.53 | 0.73 | 0.92 |
| $H_2S + NH_3$ | 1.19 | 1.48 | 2.07 |
| $H_2O$ | 2.38 | 3.75 | 3.24 |
| Hydrogen Consumption | 0.97 | 1.61 | 1.80 |

What is claimed is:

1. In an improved coal liquefaction process comprising steps of:

(a) forming in a slurry preparation zone, a slurry of finely divided coal and a pasting oil comprising a solvent for said coal, (b) pressurizing said slurry to between about 500°-3200 psig, (c) contacting said slurry with hydrogen-rich gas to form a gas/slurry mixture, (d) heating said gas/slurry mixture in the presence of said hydrogen-rich gas to a temperature between about 600°-800° F., (e) permitting the heated gas/slurry mixture to react and to dissolve at least some of said coal, (f) adding fresh hydrogen as required to form a liquified coal slurry in a liquefaction zone at a temperature of about 800-900° F., (g) passing said liquified coal slurry to a separator in which a vapor product stream and a condensed product stream are separated, (h) passing said condensed product stream to a vacuum distillation zone at a temperature of from 500°-700° F. and at a pressure of from 1-5 psia, (i) removing a residual bottoms product from said vacuum distillation zone, (j) passing said residual bottoms product to a critical solvent deashing stage wherein said residual bottoms product is mixed with a critical deashing solvent at a temperature of from about 450°-630° F. and a pressure from about 750-1000 psig to form a deashing stage slurry, (k) passing said deashing stage slurry into a first deashing separator wherein a first light upper phase and a first heavy lower phase comprising ash concentrate are separated, (l) removing said first heavy lower phasefrom said first separator, (m) passing said first light upper phase to a second deashing separator wherein a second light upper phase, substantially comprised of critical deashing solvent and a light fraction of solvent refined coal, and a second heavy lower phase, substantially comprised of a heavy fraction of solvent refined coal, are separated, and (n) passing said second upper light phase to a third deashing separator for separation of a third light upper phase comprising critical deashing solvent and a third heavy lower phase comprising a light fraction of solvent refined coal; the improvement which comprises passing at least a portion of said second heavy lower phase to said slurry preparation zone, and combining said portion of said second heavy lower phase with said finely divided coal and said solvent in said slurry preparation zone, whereby said temperature in said liquefaction zone may be reduced by about 20°–40° F., with improved yields of pentane soluble oils being obtained.

2. The improved process, as recited in claim 1, wherein said second heavy lower phase is at least 40% insoluble in benzene.

3. The improved process, as recited in claim 1, wherein said portion of said second heavy lower phase comprises up to 35% of the total pasting oil.

4. The improved process, as recited in claim 1, wherein said temperature in said liquefaction zone is reduced to about 815° F.

* * * * *